US005137011A

United States Patent [19]

Roth

[11] Patent Number: 5,137,011

[45] Date of Patent: Aug. 11, 1992

[54] GOLF BALL HEATING DEVICE

[76] Inventor: Zane W. Roth, 300-131st Ave. NE., Bellevue, Wash. 98005

[21] Appl. No.: 805,361

[22] Filed: Dec. 11, 1991

[51] Int. Cl.[5] ..... F24J 1/00

[52] U.S. Cl. ..... 126/263; 206/315.9; 273/32 D

[58] Field of Search ..... 126/263, 208, 400, 451; 273/32 R, 32 D; 128/403; 206/315.9

[56] References Cited

U.S. PATENT DOCUMENTS

| | | | |
|---|---|---|---|
| 2,181,821 | 11/1939 | Seals | 126/208 |
| 3,497,676 | 2/1970 | Gravatt | 206/315.9 |
| 3,683,155 | 8/1972 | Loofbourow | 126/263 |
| 3,720,197 | 3/1973 | Schroth | 126/451 |
| 3,773,461 | 11/1973 | Arimoto et al. | 126/263 |
| 4,155,002 | 5/1979 | Cohen | 206/315.9 |
| 4,545,362 | 10/1985 | Hendricks | 126/263 |

*Primary Examiner*—James C. Yeung
*Attorney, Agent, or Firm*—Russell W. Illich

[57] ABSTRACT

A golf ball warming device is provided for use during a round of golf. The warming device includes a main housing having a central bore which houses up to 3 golf balls. The central bore is disposed adjacent an arcuate-shaped bore which houses a disposable heating element. The heating element is chemically activated when removed from its package and radiates heat toward the golf balls disposed within its arcuate shaped bore. The golf balls and heating element are initially placed into their respective bores through a top opening within the main housing, and removed from a bottom opening when needed during play. The walls of the housing are thick in design to thermally insulate the balls within the warming device. The warming device does not use batteries, nor any other electrical current, and can operate for 5 hours at 127° F. on a single heating element.

7 Claims, 2 Drawing Sheets

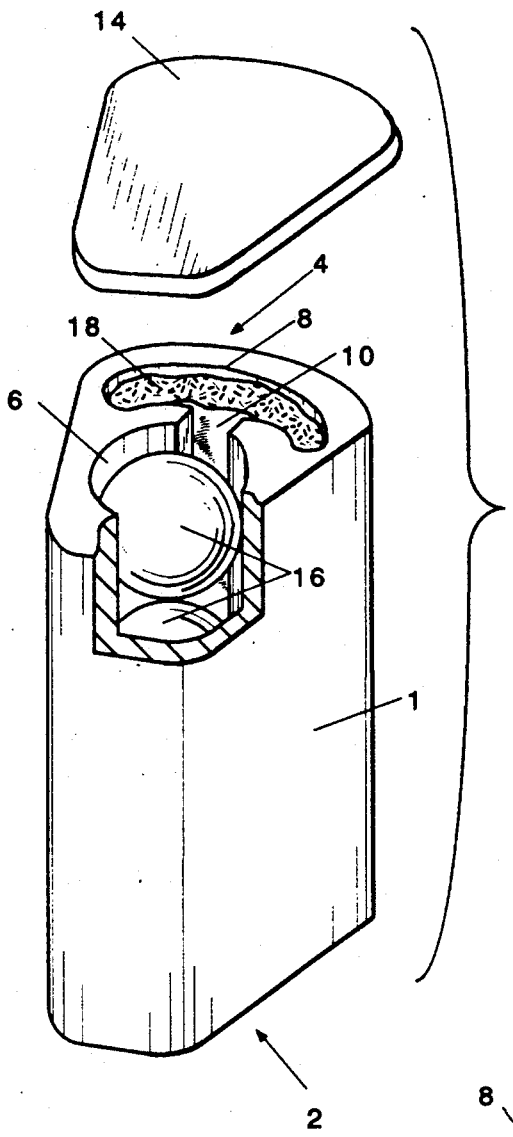
*Figure 1*
*Figure 2*
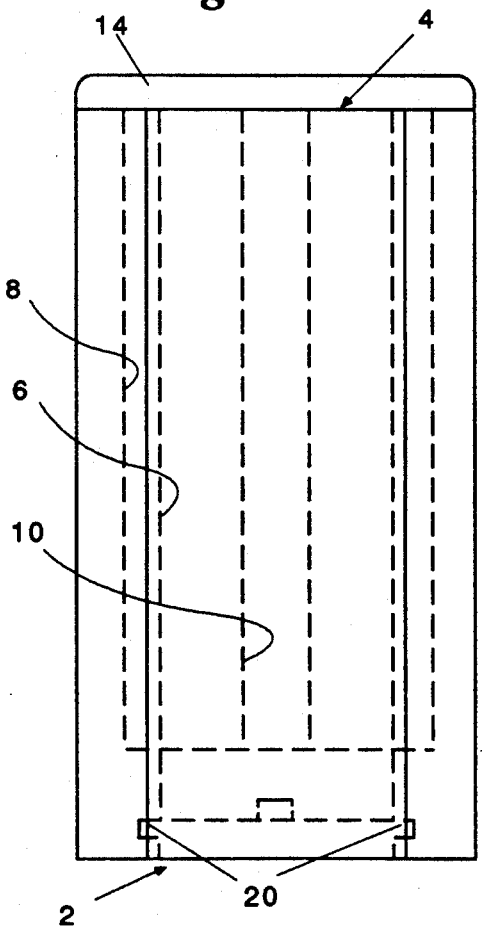

GOLF BALL HEATING DEVICE

BACKGROUND OF THE INVENTION

The present invention relates to a heating device for golf balls. It has been shown in the past that warm golf balls will travel further and respond better when hit by a golf club. Normally, in warm weather climates and warm seasons, the temperature of the golf ball is not critical. However, in colder climates or in early and late seasons such as spring and fall, the exterior temperature of a golf ball can drop to the point where it can seriously affect the performance of the golf ball. To avoid this drop in performance, various heating devices have been proposed for keeping golf balls warm when playing under cold and/or wet conditions.

The U.S. Pat. No. 3,497,676 to Gravatt discloses a golf ball warmer that uses solar energy from the sun to heat the golf balls within a container, or alternatively, uses a battery connected to heating coils for heating the balls. There are several disadvantages associated with using Gravatt's warmer. First, the warmer must be positioned on a golf cart or golf bag in an optimum position to receive the rays of the sun. This can be awkward and impossible, at times, when shadows form across the golf course from trees, hills, etc. Second, the entire warmer must be opened to remove a single ball which exposes all of the remaining balls and warmer to the cold elements. Third, solar and battery power are very weak sources of energy that would be generally unreliable for keeping golf balls consistently warm on a cold or wet day.

The U.S. Pat. No. 3,773,461 to Arimoto discloses a warmer that improves on Gravatt's design by exposing only a single ball when the container is opened. However the device of this patent suffers from a heating source located only at one end of the device. This allows for only heating one ball at a time. Many times during the game of golf, more than one ball is needed at one time, especially if two or more golfers are sharing balls or if a golfer hits into a water or similar hazard. The Arimoto device is inconvenient because of this one-at-a-time heating feature.

The U.S. Pat. No. 4,155,002 to Cohen discloses a warmer that heats a plurality of balls at the same time, while using an end chamber for removing a ball from the container without exposing the other balls to the cold or wet elements. Cohen's warming device resolves many of the disadvantages of the warmers shown in the previous two patents. However, its removal chamber makes the device unnecessarily complicated and costly. Furthermore, while the conventional AC electric power source is a strong power source, it is unavailable to a golfer while on the course. Even with the special golf ball removal chamber, heat will dissipate from Cohen's container long before a golfer can finish 9 or 18 holes. Thus, Cohen's device must ultimately rely on a weaker and more expensive power source such as batteries, as hinted within his specification.

The U.S. Pat. No. 4,545,362 to Hendricks discloses a heating device that is superior to all of the aforementioned devices. Hendricks uses a disposable hand and body warmer for chemically heating the inner chamber of a ball warming device. This chemical heating element is stronger than solar power, is less expensive than battery power, and is fully portable as opposed to standard AC household power. Another advantage to the warming device of Hendricks is that it is much simpler in design and use than the aforementioned devices. However, there are still several distinct disadvantages associated with the use of Hendrick's device.

First, the container is divided into two halves that separate to expose all of the balls to the cold elements when retrieving a single ball. Second, the container is relatively large compared to the golf balls which causes inefficient heating of the open air surrounding the balls. Third, the asymmetrical nature of the storage arrangement of the golf balls causes the balls furthest from the heating element to be heated the least. Fourth, the disposable heating element is loosely positioned within the container where it can accidentally fall out of the container when a ball is retrieved. Fifth, the disposable heating element is exposed to the cold elements across its entire surface when the container is opened causing further unnecessary dissipation of heat. Thus, the disposable heating elements are not used as efficiently as possible and wear out quickly, in use.

SUMMARY OF THE INVENTION

It is an object of this invention to provide a golf ball heating device that includes an efficient and inexpensive heating source that is not overly exposed to the cold or wet elements in use.

Another object of the invention is to provide a golf ball heating device that stores a plurality of golf balls in a minimum amount of space, with the golf balls positioned to receive heat from the heating source in an even manner across all of the golf balls within the device.

It is a further object of the invention to provide a device that is simple in design and use and that is economical in cost and manufacture.

Other objects of the invention will be apparent hereinafter from the specification and from the recital of the appended claims, particularly when read in conjunction with the accompanying drawings.

The present invention comprises a golf ball warming device having a container for holding a plurality of golf balls. The container is made of a thick walled construction for keeping the golf balls insulated from the outside elements. The container further comprises a central circular bore for housing the golf balls, an arcuate-shaped bore for housing a warming packet, and a narrow connecting passage between the circular and arcuate bores for delivering heat generated from the packet to the golf balls. A top lid is secured to the top of the container and provides access for installation and removal of the disposable heating packet. A bottom lid slides within a pair of grooves at the bottom of the container to allow access to individual heated golf balls within the container.

BRIEF DESCRIPTION OF THE DRAWINGS

FIG. 1 shows a perspective view of the warming device of the present invention holding a plurality of golf balls and the hand warming packet.

FIG. 2 shows a side plan view of the warming device of FIG. 1.

DETAILED DESCRIPTION OF THE INVENTION

Figure 6:
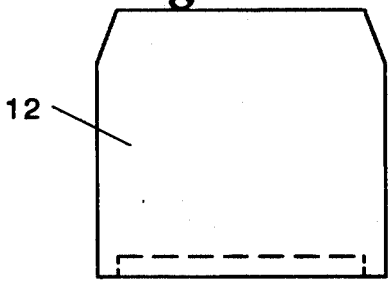
FIG. 6 shows a plan view of the bottom lid of the warming device of FIG. 1.
Figure 7:
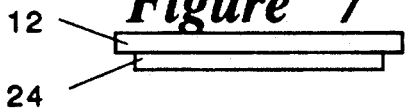
FIG. 7 shows a side view of the bottom lid of the warming device of FIG. 1.

FIG. 1 shows the preferred embodiment of the golf ball warming device of the present invention. The device includes a container 1 with a first open end 2 and a second open end 4. The open ends are defined by a central bore 6 of circular cross-section, a second elongated bore 8 of an arcuate shaped cross-section, and a narrow connecting passage 10 that connects the first bore 6 with the second bore 8. A first cover 12 (shown in FIGS. 6 and 7) covers the first open end 2, and a second cover 14 covers the second open end 4. The first cover allows access to the golf balls 16 held within the central bore 6, and the second cover 14 allows access to a disposable heating element 18.

The container 1 is constructed of thick walls, as best seen in FIG. 1. These walls insulate the container so that the heat generated from the heating element 18 is kept within the container. The thickness of the walls are at least half the thickness of the heating element 18. The insulated walls of the container are constructed of injection molded plastic.

The various dimensions of the bores within the container and their relationships with one another can best be viewed within FIG. 2. The widest bore within the container is the arc-shaped bore 8 (shown in dashed lines) which must accomodate the relatively wide heating element. The central bore 6 (shown in dashed lines) is of a width corresponding to the diameter of a golf ball. The connecting passage 10 (shown in dashed lines) is of a relatively narrow width in order to concentrate the heat from bore 8 directly onto the golf balls stored within bore 6. To concentrate the heat effectively upon the golf balls, the connecting passage is of a dimension that is less than half the width of bores 6 and 8. Another aspect of the dimensions of the bores involves the lengths of the individual bores. The arcuate-shaped bore 8 and connecting passage 10 are substantially the same length as the central bore 6. The reason for this is to spread heat evenly over all of the balls within the central bore 6. Thus, if three balls are stored within the container, at one time, all three balls are ready to be used and are warmed to the same degree.

Figure 3:
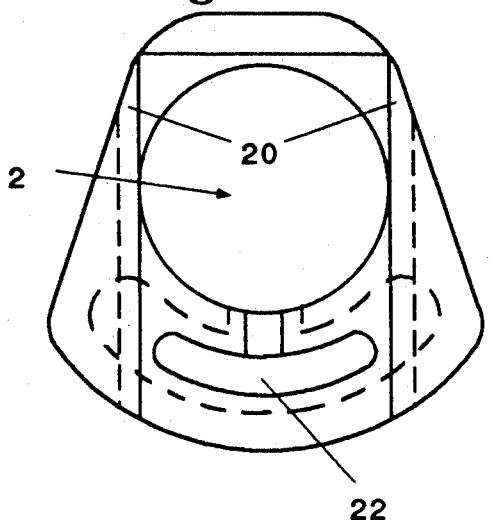
FIG. 3 shows a bottom plan view of the warming device of FIG. 1.
Figure 4:
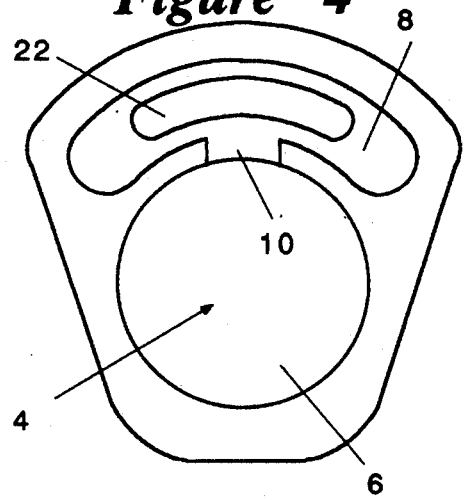
FIG. 4 shows a top plan view of the warming device of FIG. 1.
Figure 5:
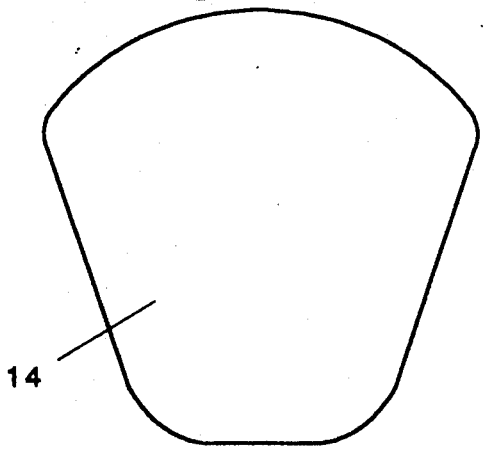
FIG. 5 shows a plan view of the top lid of the warming device of FIG. 1.

FIGS. 3 and 4 show the opposite ends 2 and 4, respectively. These ends 2 and 4 are covered by the first cover 12 (shown in FIGS. 6 and 7) and the second cover 14 (shown in FIG. 5), respectively.

In operation, one, two or three golf balls are placed through the top open end 4 into the central bore 6, and a disposable heating element 18 is placed within the arcuate-shaped bore 8. The disposable heating element is removed from its packaging prior to its placement within bore 8 to begin its chemically activated heating. The top lid 14 is secured over the top end 4 and the warming device 1 is stored within the golfer's bag or cart. When the golfer desires to use a heated ball, the bottom lid 12 is slid open to allow a single ball to drop from the central bore 6. The bottom lid is then replaced to its covered position, and the remaining ball(s) within the bore 6 continue to be heated by the heating element 18. When the golfer desires additional heated balls to replace the previously removed balls, the top lid 14 is opened and the replacement balls are placed into the central bore from the top end 4. A single heating element will hold golf balls at 127° F. for 5 hours at a time. Usually, 18 holes (or a full round of golf) can be completed in 5 hours. Thus, only one heating element is needed per round of golf.

The disposable heating element is a conventional hand and pocket warmer. An example of one is marketed under the name "Grabber Mini-Mini Heater" and manufactured by MyCoal Warmers Co., Ltd.®. Details of the warmer may be seen within U.S. Pat. No. 3,976,049.

The warming device of the present invention has many unique advantages over the prior art of record, as related within the Background of the Invention. Additionally, it should be pointed out that the present invention is not electrical in nature. This is significant for two reasons. First, in wet weather there is no chance for the device to be damaged or shorted due to moisture that could enter into the device. Second, match play in the game of golf prohibits the use of any electrical appliance. Thus, the chemically operable warming device of the present invention has additional utility due to its non-electrical nature.

It should be apparent that many modifications could be made to the warming device which would still be encompassed within the spirit of the present invention. For example, the warming device could include a clip to enable it to be attached to a golf bag or golf cart. It is intended that all such modifications may fall within the scope of the appended claims.

What is claimed is:

1. A golf ball warming device comprising:

a container comprising a central bore having a substantially circular cross-section, a second elongated bore extending parallel to said central bore, and a connecting passage between said central bore and said second bore;

said container having a first open end adjacent an open end of said central bore, said central bore having a diameter equivalent to the diameter of a golf ball and a length equivalent to at least twice the diameter of a golf ball allowing said central bore to house at least two golf balls;

a securable cover for closing said first open end;

a disposable heating element disposed within said second bore;

said connecting passage having a length substantially equivalent to the lengths of said central and second bores, and said connecting passage having a width of less than half of the width of said central and second bores to concentrate the heat from said heating element along the surfaces of all golf balls held within said central bore;

wherein, said golf balls are inserted and removed from said first open end of said container when said cover is partially removed to expose only a single golf ball positioned towards said open end of said bore.

2. A golf ball warming device as claimed in claim 1, wherein, said container comprises walls of a thickness substantially equivalent to the half the thickness of said portable heating element to insulate said container and keep the heat generated by said heating element within said container.

3. A golf ball warming device as claimed in claim 1, wherein, said cover is slidably disposed within a wide notch at said first open end of said container, said notch located adjacent said open end of said central bore.

4. A golf ball warming device as claimed in claim 1, wherein, said second bore having an arcuate shaped cross-section.

5. A golf ball warming device as claimed in claim 1, wherein, said heating element comprises a chemically reactive material that expends heat when exposed to ambient air, said container comprises a vent opening within said second bore to expose said heating element to ambient heat and cause said element to expend heat through said connecting passage towards the golf balls within said central bore.

6. A golf ball warming device as claimed in claim 1, wherein, said container further comprises a second cover for closing a second open end of said container opposite said first open end of said container, said second bore having an open end adjacent said second open end of said container for allowing insertion and removal of said disposable heating element.

7. A golf ball warming device as claimed in claim 1, wherein, said length of said central bore is substantially equivalent to three times the diameter of a golf ball to hold three golf balls therein.

* * * * *